US005288596A

United States Patent [19]

Hayashi

[11] Patent Number: 5,288,596

[45] Date of Patent: Feb. 22, 1994

[54] BLACK AND WHITE DIRECT POSITIVE IMAGE FORMING PROCESS

[75] Inventor: Katsumi Hayashi, Kanagawa, Japan

[73] Assignee: Fuji Photo Film Co., Ltd., Kanagawa, Japan

[21] Appl. No.: 913,628

[22] Filed: Jul. 16, 1992

[30] Foreign Application Priority Data

Jul. 17, 1991 [JP] Japan ..... 3-201158

[51] Int. Cl.[5] ..... G03C 5/305

[52] U.S. Cl. ..... 430/410; 430/441; 430/465; 430/485; 430/487

[58] Field of Search ..... 430/410, 465, 441, 482, 430/485, 487

[56] References Cited

U.S. PATENT DOCUMENTS

| | | | |
|---|---|---|---|
| 3,808,003 | 4/1974 | Hara et al. | 430/487 |
| 5,035,984 | 7/1991 | Hayashi et al. | 430/410 |
| 5,112,732 | 5/1992 | Hayashi et al. | 430/410 |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A black and white direct positive image forming process is disclosed. The process comprises imagewise exposing to light a silver halide light sensitive material and developing the material with a black and white developing solution. The light-sensitive material comprises a non-pre-fogged internal latent image type silver halide emulsion layer provided on a support. The material further contains a quaternary salt nucleating agent and a nucleating accelerator. In the present invention, the black and white developing solution contains an imidazole compound and a benzotriazole compound. The amount of the benzotriazole compound is preferably in the range of 0.1 to 10 wt.% of the amount of the imidazole compound. The black and white direct positive image is preferably formed on a computer output microfilm (COM).

14 Claims, No Drawings

BLACK AND WHITE DIRECT POSITIVE IMAGE FORMING PROCESS

FIELD OF THE INVENTION

The present invention relates to a black and white direct positive image forming process. In more detail, the invention relates to a process for formation of a black and white direct positive image on a computer output microfilm (COM).

BACKGROUND OF THE INVENTION

Rapid developments of computers have made the information industries of today so prosperous. Studies on methods to output a great amount of recorded information have been enthusiastically made. In this technical field, a reversal silver halide photographic material has been used as the recording material. In the reversal image forming process, a negative image is formed by a first development; the negative image is bleached without fixing to remove a reduced silver from the negative image (desilvering); the remaining undeveloped silver halide is exposed to light; and a second development is carried out to form a positive image. The steps of the process are so complicated that a finishing speed of the film is slow and a maximum density (Dmax) and a minimum density (Dmin) are not stable. Further, a strong oxidizing agent such as potassium dichromate must be used in a bleaching bath.

A direct positive image forming process has been proposed to solve the problems of the reversal image forming process. In this process, a direct positive image can be obtained without using a negative film.

The known direct positive silver halide photographic materials can be classified into two types exclusive of special cases which are not practically used.

One is a process using a fogged silver halide emulsion. A direct positive image is by a developing process after the fogged nuclei (latent image) is destroyed within the exposed area by solarization or Herschel effect.

The other is a process using a non-pre-fogged internal latent image type silver halide emulsion. A direct positive image is obtained by carrying out an imagewise exposure and then conducting a surface developing process after or simultaneously with a fogging treatment.

A process of using a nucleating agent, called "chemical fogging process" has been known to produce selectively a fogged nucleus as is described above. The fogging process is described in "Research Disclosure", Vol. 151, No. 15,162, p. 72–87 (Nov. 1976).

The internal latent image type silver halide emulsion means such a silver halide emulsion that sensitivity specks exist mainly inside the silver halide grains and a latent image is formed mainly inside the grains by exposure.

The process of the latter type generally has a higher sensitivity as compared with the process of the former type. Therefore, the internal latent image type is suitable for use application in which a high sensitivity is required.

Various internal latent image type emulsions have been proposed in this technical field. For example, the emulsions are described in U.S. Pat. No. 2,592,250, No. 2,466,957, No. 2,497,875, No. 2,588,982, No. 3,317,322, No. 3,761,266, No. 3,761,276 and No. 3,796,577, and U.K. Patents No. 1,011,062, No. 1,151,363 and No. 1,150,553. The photographic material described in these documents has a relatively high sensitivity for the direct positive type.

The direct positive image forming system is described in detail in T.H. James, "The Theory of the Photographic Process" 4th ed., Chap. 7, pp. 182–193 and U.S. Pat. No. 3,761,276.

The developing solution of the non-pre-fogged internal latent image type silver halide light-sensitive material usually is a high alkaline solution of hydroquinone-metol or hydroquinone pyrazolidone having a pH value of not less than 10.5.

An amino compound has been contained in the developing solution to accelerate the development. Japanese Patent Provisional Publication No. 56(1981) - 106244 discloses an amino compound such as N-methylaminoethanol.

N-methylaminoethanol is relatively inexpensive and easily available, and shows excellent developing effect. However, it has various problems as is described below.

1. Amines usually have offensive odor like fish. The odor is unfavorable in various stages such as preparation of a developing solution, introduction of the solution and treatment of the solution.

2. Lower alkyl amines (e.g., N-methylaminoethanol) have a low boiling point. They often produce smoke when the solution is handled. The smoke adheres to the surrounding machines and walls to make those machines and walls sticky.

3. Amines have a high absorption capacity of $CO_2$ existing in the atmosphere, so that the amines absorb $CO_2$ from the atmosphere having a large amount of $CO_2$, whereby pH of the developer is lowered. Therefore, the developing activity is decreased.

4. It is known that amines often deteriorate plastic parts of an automatic developing machine which is used for the photographic process.

5. For the effective developing acceleration, a large amount such as an amount of 40 to 80 g per 1 liter of the developing solution is needed, so that the cost becomes high and the concentration of the developer is difficult.

6. Amines are liquid at normal temperatures Therefore, they cannot be used to prepare the later-described one-pack type powdery processing agent which is advantageously used for saving the space of containers.

SUMMARY OF THE INVENTION

An object of the present invention is to provide a black and white direct positive image forming process, wherein the developing solution is free from the above-mentioned problems and is capable of rapidly forming a stable direct positive image having high Dmax and low Dmin.

Another object of the invention is to provide a black and white direct positive image forming process for COM having high workability and high safety.

A further object of the invention is to provide a black and white direct positive image forming process using a one-pack type powdery developing agent.

There is provided by the present invention a black and white direct positive image forming process which comprises imagewise exposing to light a silver halide light-sensitive material and developing the material with a black and white developing solution, said light-sensitive material comprising a non-pre-fogged internal latent image type silver halide emulsion layer provided on a support, and said material further containing a quaternary salt nucleating agent and a nucleating accelerator, wherein the black and white developing solution contains an imidazole compound represented by the formula [A]and a benzotriazole compound represented by the formula [B]:

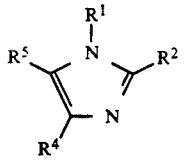

[A]

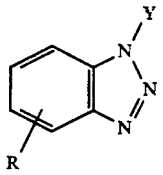

[B]

wherein each of $R^1$, $R^2$, $R^4$ and $R^5$ independently is hydrogen, an alkyl group, a hydroxyalkyl group or an alkenyl group; Y is hydrogen or mercapto; R is hydrogen, a halogen atom, nitro, amino, cyano, hydroxyl, mercapto, sulfo, carboxyl, an alkyl group, an alkenyl group, an alkynyl group, an aryl group, an alkoxy group, an acyl group or an alkoxycarbonyl group.

The present inventor surprisingly finds that the developing solution containing both the imidazole compound and the benzotriazole compound is advantageously used in the black and white direct positive image forming process. The function of the mixture of the imidazole compound and the benzotriazole compound is more excellent than those of the conventional amine compounds. Therefore, the process of the present invention rapidly forms a stable direct positive image having high Dmax and low Dmin. Further, the developing solution used in the present invention is free from the problems of the conventional developing solution. Particularly, the developing solution of the present invention can be fed from a one-pack type powdery developing agent. These effects of the invention are especially advantageous to a computer output microfilming (COM).

DETAILED DESCRIPTION OF THE INVENTION

The present invention is characterized in that the black and white developing solution contains an imidazole compound represented by the formula [A]and a benzotriazole compound represented by the formula [B]:

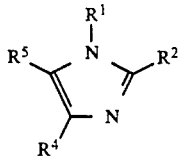

[A]

-continued

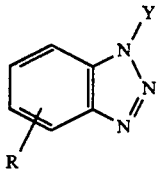

[B]

In the formula [A], each of $R^1$, $R^2$, $R^4$ and $R^5$ independently is hydrogen, an alkyl group, a hydroxyalkyl group or an alkenyl group. At least one of $R^1$, $R^2$, $R^4$ and $R^5$ preferably is an alkyl group or a hydroxyalkyl group. The number of the carbon atom contained in each of $R^1$, $R^2$, $R^4$ and $R^5$ preferably is 10 or less, and more preferably is 6 or less.

Examples of the imidazole compounds represented by the formula [A]include imidazole, 2-methylimidazole, 4-methylimidazole, 2,4-dimethylimidazole, 1,2-dimethylimidazole, 1-methylimidazole, 2-ethyl-4-methylimidazole, 2-amylimidazole, 1-isoamyl-2-methylimidazole, 4,5-dimethylimidazole, 2-ethylimidazole, 1-methylimidazole, 2,4,5-trimethylimidazole, 4-hydroxymethyl-5-methylimidazole, 4-(β-hydroxyethyl)-5-methylimidazole, 1-allyl-2-methylimidazole, 1-vinyl-2-methylimidazole, 4-hydroxymethylimidazole, 4-(β-hydroxyethyl)imidazole, 2-hydroxymethylimidazole, and 1-(β-hydroxyethyl)imidazole. Imidazole, 2.methylimidazole, 4-methylimidazole, 1,2-dimethylimidazole and 1-methylimidazole are particularly preferred.

The imidazole compounds have already been known. The syntheses of the imidazole compounds are described in "The Chemistry of Heterocyclic Compounds Imidazole and Derivatives", 1953, Interscience Publishers Inc. New York.

In the formula [B], Y is hydrogen or mercapto; R is hydrogen, a halogen atom, nitro, amino, cyano, hydroxyl, mercapto, sulfo, carboxyl, an alkyl group, an alkenyl group, an alkynyl group, an aryl group, an alkoxy group, an acyl group or an alkoxycarbonyl group. The alkyl group, the alkenyl group, the alkynyl group, the aryl group, the alkoxy group, the acyl group and the alkoxycarbonyl group may have one or more substituent groups. Y preferably is hydrogen. R is preferably attached to 5-position of the benzotriazole ring. The number of the carbon atom contained in the alkyl group, the alkenyl group, the alkynyl group, the alkoxy group, the acyl group and the alkoxycarbonyl group preferably is 10 or less, and more preferably is 6 or less. The number of the carbon atom contained in the aryl group preferably is 20 or less, and more preferably is 10 or less.

Examples or the benzotriazole compounds represented by the formula [B]include benzotriazole, 5-methylbenzotrizole, 5-chlorobenzotriazole, 5-nitrobenzotriazole, 5-ethylbenzotriazole, 5-carboxybenzotriazole, 5-hydroxybenzotriazole, 5-aminobenzotriazole, 5-sulfobenzotriazole, 5-cyanobenzotriazole, 5-methoxybenzotriazole, 5-ethoxybenzotriazole and 5-mercaptobenzotriazole. Benzotriazole, 5-methylbenzotriazole, 5-chlorobenzotriazole and 5-aminobenzotriazole are particularly preferred.

These benzotriazole compounds are known as antifogging agents in the photographic art. They can be synthesized by conventional synthetic methods. Some of them are commercially available as chemical reagents.

Japanese Patent Publication No. 47(1971) 45541 describes that the imidazole compounds represented by the formula [A]is used as a development accelerator. However, the publication is silent with respect to the non-pre-fogged internal latent image type reversal silver halide light-sensitive material.

The imidazole compound represented by the formula [A]is solid, while the conventional amines are liquid. Therefore, a one pack type powdery developing agent is available in the present invention.

The amounts of the imidazole compound and the benzotriazole compound are determined based on the activity of the silver halide contained in the light-sensitive material, the natures and the amounts of the nucleating agent and the nucleating accelerator and the composition of the developing solution. The amount of the benzotriazole compound is preferably in the range of 0.1 to 10 wt.% of the amount of the imidazole compound. The amount of the imidazole compound is preferably in the range of 0.1 to 20 g and more preferably in the range of 1 to 8 g based on 1 liter of the developing solution The amount of the benzotriazole compound is preferably in the range of 0.005 to 1.0 g and more preferably in the range of 0.02 to 0.1 g based on liter of the developing solution.

The combination of the imidazole compound with the benzotriazole has an excellent developing acceleration function. Accordingly, the developing process of the present invention is accelerated. Therefore, a rapid development is possible without raising the developing temperature. Of course, the developing process of the present invention can be much more accelerated by raising the developing temperature.

The developing solution preferably contains a dihydroxybenzene developing agent. A combination of a dihydroxybenzene developing agent with a 1-phenyl-3-pyrazolidone developing agent and a combination of a dihydroxybenzene developing agent with a p-aminophenol developing agent are more preferred.

Examples of the dihydroxybenzene developing agents include hydroquinone and chlorohydroquinone. Hydroquinone is particularly preferred.

Examples of the 1-phenyl-3-pyrazolidone developing agents include 1-phenyl-3-pyrazolidone, 1-phenyl-4,4-dimethyl-3-pyrazolidone 1-phenyl-4-methyl-4-hydroxymethyl-3-pyrazolidone.

Examples of p-aminophenol developing agents include N-methyl-p-aminophenol, p-aminophenol and N-($\beta$-hydroxyethyl) p-aminophenol and N-($\beta$-hydroxyethyl)-p-aminophenol. N-methyl-p-aminophenol is particularly preferred.

The developing agent is generally used in an amount of 0.05 mol/liter to 0.8 mol/liter. In the case of using a combination of dihydroxybenzenes with 1-phenyl-3-pyrazolidones or a combination of dihydroxybenzenes with p-aminophenols, it is preferred to use the dihydoxybenzenes in an amount of 0.05 mol/liter to 0.5 mol/liter and the other in an amount of not more than 0.06 mol/liter.

The developing solution preferably contains a sulfite as a preservative. Examples of the sulfites include sodium sulfite, potassium sulfite, sodium bisulfite and potassium metabisulfite. The sulfite is preferably used in an amount of not less than 0.25 mol/liter.

The developing solution of the invention has a pH value in the range of 10.0 to 12.3, and preferably in the range of 10.3 to 11.8. An alkali agent used for adjusting the pH value is an ordinary water-soluble inorganic alkali metal salt (e.g., sodium hydroxide and sodium carbonate).

The developing solution can contain buffering agents. Examples of the buffering agents include boric acids, sugars (e.g., sucrose) (cf., Japanese Patent Provisional Publication No. 60(1985)-93433), oximes (e.g., acetoxime), phenols (e.g., 5-sulfosalycilic acid) and tribasic phosphates. Examples of the other additives of the developing solution include pH adjusting agents such as sodium.. hydroxide, potassium hydroxide, sodium carbonate and potassium carbonate; development inhibitors such as sodium bromide, potassium bromide and potassium iodide; organic solvents such as ethylene glycol, diethylene glycol and triethylene glycol; development accelerators such as alkanolamines (e.g., diethanol and triethanolamine), amino compounds and derivatives thereof (cf., Japanese Patent Provisional Publication No. 56(1981)-106244); and anti-fogging agents such as mercapto compounds (e.g., 1-phenyl-5-mercaptotetrazole) and indazole compounds (e.g., 5-nitroindazole). The developing solution can further contain toning agents, surface active agents, anti-foaming agents, hard water-softening agents or hardening agents, if necessary.

By the way, a demand for reducing waste products has recently been extended to protect the environment. From a viewpoint of disposal of processing agent containers, powdery agents are more advantageous than liquid agents because of small bulkiness of powder. The developing solution of the present invention can be fed from a one-pack type powdery developing agent. Laminated powdery agents having an inert layer (cf., EP 196551) are preferred from the viewpoints of transportation cost, storage space, work-ability and stability with time.

Examples of the light sources for exposure include natural light (sun light), a tungsten lump, a fluorescent lamp, a mercury lamp, a xenon arc lamp, a carbon arc lamp, a xenon flash lamp, a cathode ray tube frying spot, a light emitting diode, a laser beam (e.g., gas laser, YAG laser, dye laser, semiconductor laser) and an infrared ray. Further, a fluorescent substance excited with electron ray, X-ray, $\gamma$-ray or $\alpha$-ray is also available as the light source. The exposing time is usually 0.001 to 1 second. A shorter exposing time (0.00001 to 0.001 second) is possible in the case that a xenon flash lamp or a cathode ray tube is used as the light-source. A longer exposing time (1 second or more) is also possible.

In the process of the present invention, the image is preferably formed from computer output. In this case, the light-sensitive material usually is a microfilm, and the image usually is a black and white binary image.

After the development, the light-sensitive material is usually fixed using an aqueous solution containing a fixing agent. The fixing solution can further contain an acid hardening agent, an acetic acid or a dibasic acid.

The fixing solution has a pH value of not less than 3.8, preferably in the range of 4.4 to 8.0.

The fixing agent contains thiosulfate such as sodium thiosulfate and ammonium thiosulfate as the essential component. Ammonium thiosulfate is preferably used from the viewpoint of fixing speed. The amount of the fixing agent can be appropriately changed. The amount generally is in the range of about 0.1 to 5 mol/liter.

The fixing solution can contain a mesoion compound (cf., Japanese Patent Application No. 2(1990) - 296400)

An example of the acid hardening agent is a water-soluble aluminum salt. The acid hardening agent is preferably used in an amount of 0.01 to 0.2 mol/liter.

Examples of the dibasic acids include tartaric acid or its derivative and citric acid or its derivative. Two or more of the dibasic acids may be used in combination. The dibasic acids are effectively contained in the fixing solution in an amount of not less than 0.005 mole per 1 liter of the fixing solution.

The fixing solution may further contain preservatives (e.g., sulfite and bisulfite), pH buffering agent (e.g., acetic acid and boric acid), pH adjusting agent (e.g., sulfuric acid), chelating agents and potassium iodide.

According to the process of the invention, the developed and fixed light-sensitive material is then washed and dried.

A replenishing amount of the washing water can be not more than 1,200 ml/m$^2$ (including 0).

The case where the replenishing amount of the washing water (or stabilizing bath) is 0 means that the washing is carried out by so-called "a submerged washing process".

In the washing bath or the stabilizing bath, isothiazoline compounds described in R.T. Kselman "J. Image, Tech.", Vol. 10, No. 6242 (1984), isothiazoline compounds described in Research Disclosure (R.D.) Vol. 205, No. 20526 (May 1981) can be employed as microbiocides. The washing bath or the stabilizing bath may also contain other compounds as described in Hiroshi Horiguchi, "Chemistry of Microbiocide and Mildewcide", published by Sankyo Shuppan (1982) and "Handbook of Microbiocide and Mildewcide Techniques", Japan Microbiocide and Mildewcide Institute, published by Hakuhodo (1986).

Further, a water-soluble surface active agent and an anti-foaming agent may be added to prevent water bubble marks which are liable to occur in the washing process using a small amount of washing water and/or to prevent transference of a processing agent component attached to a squeegee roller onto a processed film.

The temperatures for the developing process, the fixing process and the washing process are selected generally from 18° C. to 50° C., preferably from 25° C. to 43° C.

The developing process of the invention is suitable for a rapid processing using an automatic developing machine (e.g., deep tank type or slate type).

The light-sensitive material of the present invention contains a quaternary salt nucleating agent and a nucleating accelerator. The quaternary salt nucleating agent and the nucleating accelerator is contained in the silver halide emulsion layer or another hydrophilic colloidal layer.

The quaternary salt nucleating agent preferably is a compound represented by the formula (X):

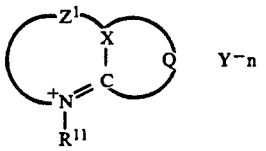

[X]

wherein X is

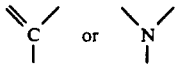

$Z^1$ is a nonmetallic atom group forming a 5- or 6-membered heterocyclic ring; the heterocyclic ring may be condensed with an aromatic ring or a heterocyclic ring; $R^{11}$ is an aliphatic group; Q is a non-metallic atom group forming a 4- to 12-membered nonaromatic hydrocarbon or heterocyclic ring; at least one of $R^{11}$, the substituent groups of $Z^1$ and the substituent groups of Q contains an alkynyl group; Y is a counter ion for charge balance; and n is a number necessary for keeping the charge balance.

In the formula [X], each of $R^{11}$, $Z^1$ and Q may have an adsorption accelerating group to the silver halide.

Examples of the quaternary salt nucleating agents and syntheses thereof are described in Japanese Patent Provisionl Publication No. 1(1989) - 224758.

Examples of the quaternary salt nucleating agents represented by the formula [X]are shown below.

(X-1)

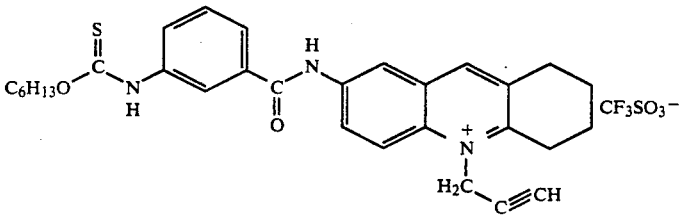

(X-2)

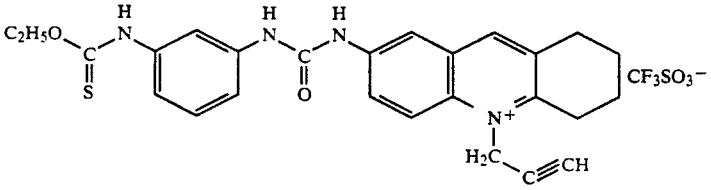

-continued
(X-3)
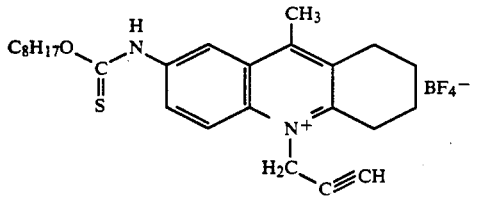
(X-4)
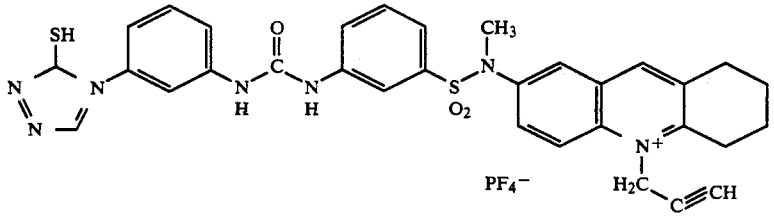
(X-5)
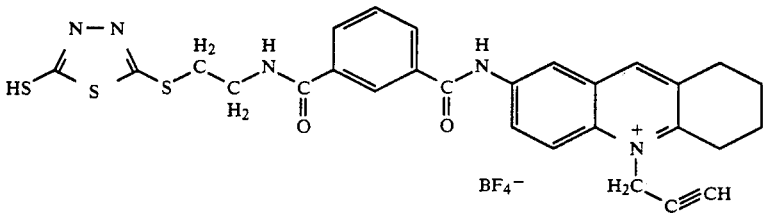
(X-6)
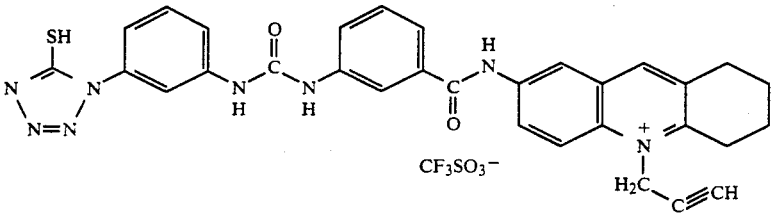
(X-7)
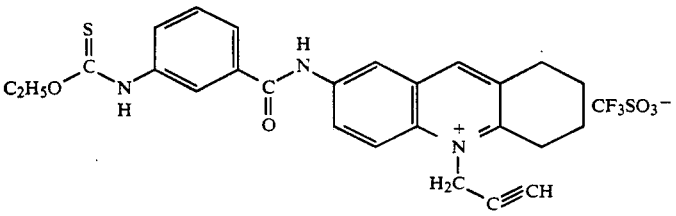
(X-8)
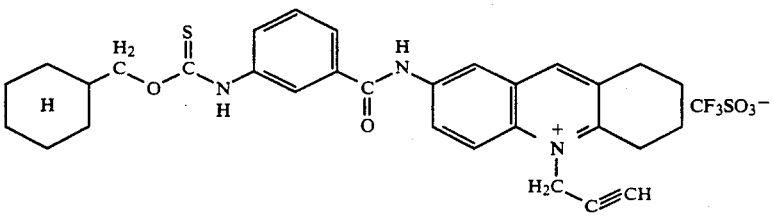
(X-9)
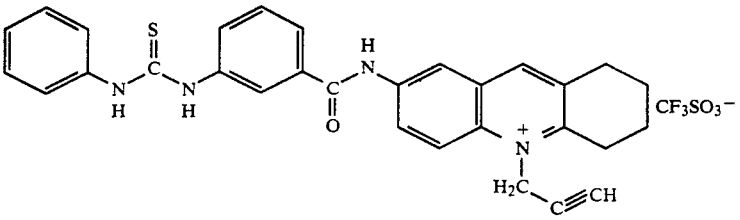

-continued (X-10)

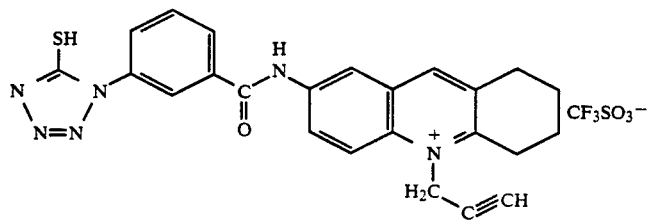

The amount of the quaternary salt nucleating agent is preferably in the range of $1\times10^{-7}$ to $1\times10^{-5}$ mole based on 1 mole of silver halide.

a nucleating accelerator is used to accelerate the function of the nucleating agent. Therefore, the accelerator increases a maximum density of the direct positive image and/or shortens the developing time required for obtaining a fixed density of the direct positive image. The nucleating accelerator preferably is a thiadiazole, diazole, triazole or tetrazole compound having a mercapto group.

Examples of the nucleating accelerators useful for the invention are shown below.

(II-1)

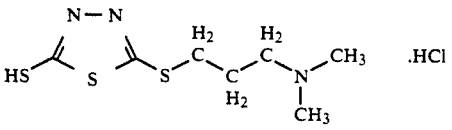

(II-2)

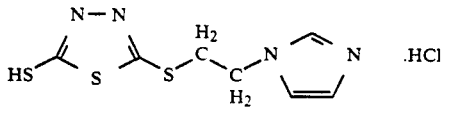

(II-3)

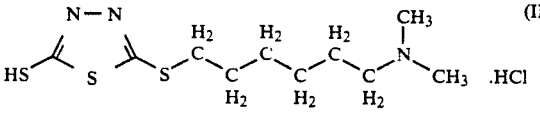

(II-4)

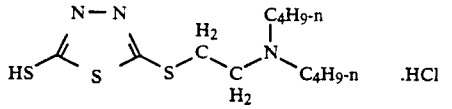

(II-5)

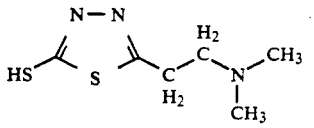

(II-6)

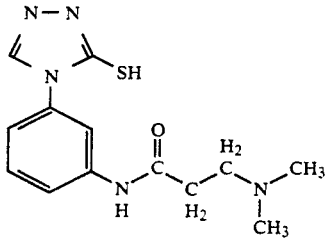

-continued (II-7)

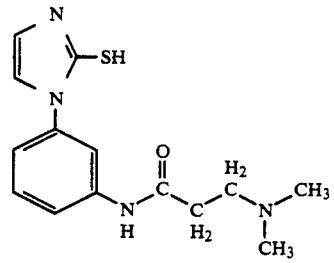

(II-8)

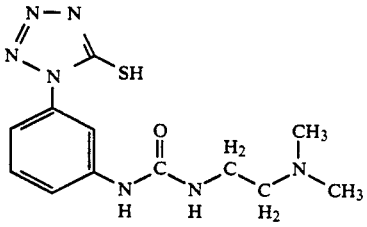

(II-9)

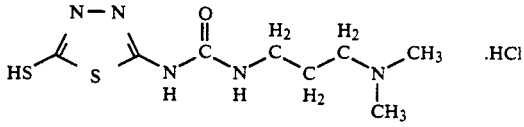

Examples of the nucleating accelerators and syntheses thereof are described in Japanese Patent Provisional Publication No. 1(1989) - 224758.

The amount of the nucleating accelerator is preferably in the range of $1\times10^{-4}$ to $1\times10^{-2}$ mole based on 1 mole of silver halide.

The non-pre-fogged internal latent image type silver halide emulsion used in the invention contains silver halide grains in which the surface has not been pre-fogged and a latent image is formed mainly in the inside of the grains. The ratio of the maximum density formed by using the following developing solution A (internal type developing solution) to that formed by using the following developing solution B (surface type developing solution) preferably is not less than 5 to 1, and more preferably is not less than 10 to 1. The maximum density of the solution A is determined by a normal photographic density measurement of the sample prepared by the process comprising: coating a certain amount of the emulsion on a transparent support; exposing to light the emulsion for a certain period within 0.01 to 10 seconds; and developing the emulsion in the developing solution A at 20° C. for 6 minutes. The maximum density of the solution B is determined in the same manner, except that development is carried out in the developing solution B at 18° C, for 5 minutes.

Surface type developing solution B:

| | |
|---|---|
| Metol | 2.5 g |

-continued

| | |
|---|---|
| 1-Ascorbic acid | 10 g |
| $NaBO_2.4H_2O$ | 35 g |
| KBr | 1 g |
| Water | to make up to 1 l |
| Internal type developing solution A: | |
| Metol | 2 g |
| Anhydrous sodium sulfite | 90 g |
| Hydroquinone | 8 g |
| Sodium carbonate (monohydrate) | 52.5 g |
| KBr | 5 g |
| KI | 0.5 g |
| Water | to make up to 1 l |

There is a problem that an occurrence frequency of re-reversal negative image in the high intensity exposure generally becomes higher as a sensitivity of the direct positive emulsion is higher. Particularly, the COM film is required to have a high sensitivity in the exposure of short period. Therefore, prevention of the re-reversal negative image is important in the high intensity exposure.

To prevent the re-reversal negative image, it is preferred to add an iron complex compound to the silver halide emulsion (cf., Japanese Patent Provisional Publication No. 2(1990) - 259749).

Examples of the iron complex compounds employable in the invention include potassium hexacyanoferrite(II) ($K_4[Fe(CN)_6]3H_2O$); potassium hexacyanoferrite(III) ($K_3[Fe(CN)_6]$); and EDTA iron complex salt. The amount of the iron complex compound added to the silver halide emulsion is preferably in the range of $10^{-9}$ to $10^{-2}$ mole, more preferably $10^{-6}$ to $10^{-4}$ mole, per 1 mole of the silver halide. These compounds may be used in combination of two or more kinds. Addition of these compounds can be appropriately made in any stages of the process for preparing the non-pre-fogged internal latent image type silver halide emulsion. That is, the compounds may be added in any of a stage of forming core grain nuclei, a stage of growing core grain nuclei, a stage of chemical ripening of core grains and a stage of growing shells which covers the cores in the process for preparing the non-pre-fogged internal latent image type silver halide grains. Particularly, the compound is preferably incorporated into the silver halide grains, and more preferably into the silver halide grains during the shell growing stage.

The silver halide emulsion is preferably spectrally sensitized with a sensitizing dye represented by the formula [III]:

[III]

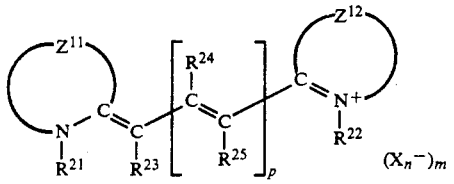

wherein each of $Z^{11}$ and $Z^{12}$ independently is an atom group forming a 5- or 6-membered nitrogen containing heterocyclic ring; p is 0 or 1; each of $R^{21}$ and $R^{22}$ independently is an alkyl group or an alkenyl group having 10 or less carbon atoms; each of $R^{23}$ and $R^{25}$ is hydrogen, or in the alternative, $R^{23}$ and $R^{21}$ or $R^{25}$ and $R^{22}$ may be linked to each other to form a 5- or 6-membered ring; $R^{24}$ is a hydrogen atom or an alkyl group having 10 or less carbon atoms (preferably 5 or less carbon atoms); $X_n$ is an anionic residue of an acid; and m is 0 or 1.

When p is 0, preferred examples of the heterocyclic ring of $Z^{11}$ and $Z^{12}$ include thiazole, benzothiazole, naphthothiazole, dihydronaphthothiazole, selenazole, benzoselenazole, naphthoselenazole, dihydronaphthoselenazole, oxazole, benzoxazole, naphthoxazole, benzimidazole, naphthoimidazole, pyridine, quinoline, imidazo[4,5-b]quinozaline and 3,3-dialkylindolenine. When p is 1, $Z^{11}$ preferably is thiazoline, thiazole, benzothiazole, selenazoline, selenazole, benzoselenazole, oxazole, benzoxazole, naphthoxazole, imidazole, benzimidazole, naphthoimidazole or pyrroline, and $Z^{12}$ preferably is oxazoline, oxazole, benzoxazole, naphthoxazole, thiazoline, selenazoline, pyrroline, benzimidazole or naphthoimidazole.

The alkyl group and alkenyl group may have one or more substituent groups. Examples of the alkyl group include methyl, ethyl, propyl, methoxyethyl and phenethyl.

In the case that the compound represented by the formula [III]is an intramolecular salt, m is 0.

Examples of the compounds represented by the formula [III]are shown below.

(III-1)

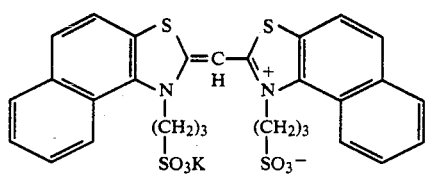

(III-2)

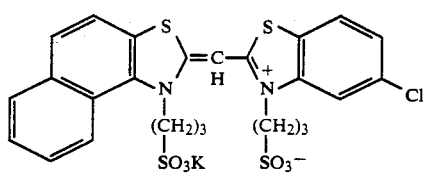

(III-3)

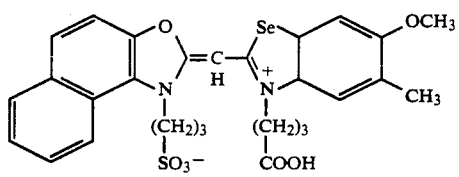

(III-4)

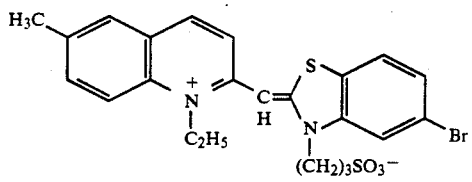

(III-5)

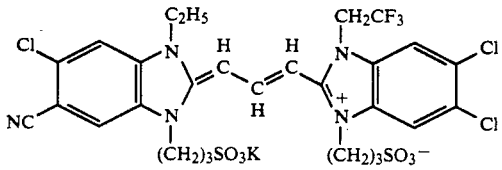

-continued (III-6)

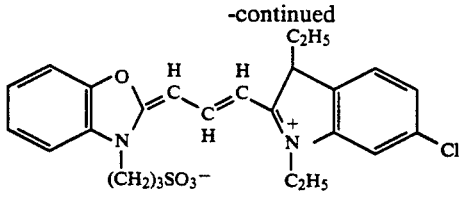

(III-7)

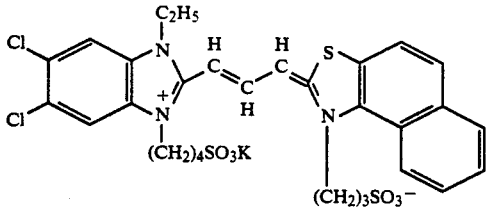

(III-8)

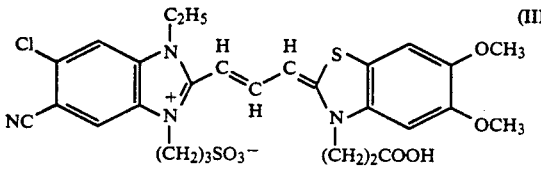

(III-9)

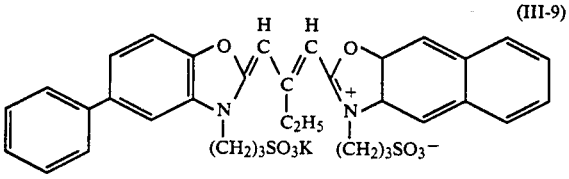

(III-10)

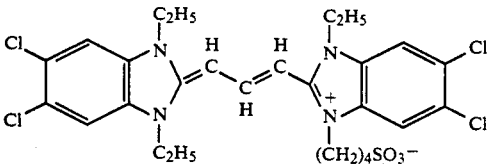

The amount of the sensitizing dye is preferably in the range of $1\times10^{-4}$ to $1\times10^{-2}$ mole based on 1 mole of silver halide.

As representative examples of the silver halides, there can be mentioned mixed silver halides such as silver chlorobromide, silver chloroiodide and silver iodobromide, other than silver chloride and silver bromide. The silver halide preferably used in the invention is a salt not containing silver iodide or containing it in an amount of not more than 3%, such as silver (iodo)bromide, silver (iodo)chloride or silver chloro (iodo)bromide.

A mean grain size of the silver halide grains is preferably not more than 2 μm and not less than 0.1 μm, particularly preferably not more than 1 μm and not less than 0.15 μm. The mean grain size is expressed by a grain diameter in the case where the grains are spherical or nearly spherical. In the case where the grains are cubic, the mean grain size is expressed by an average based on the projected area when the edge length is a grain size. The grain size distribution may be either narrow or wide, but for the purpose of improving graininess, sharpness, preferred is such a narrow grain size distribution that grains of not less than 90% (particularly not less than 95%) in all of the grains in terms of the number or weight of the grains have grain sizes within the range of ±40% of the mean grain size (more preferably within the range of ±30%, most preferably within the range of ±20%). That is, so-called "a monodispersed silver halide emulsion" is preferably used in the invention. Further, to obtain the aimed gradation of the light-sensitive material, two or more kinds of the monodispersed silver halide emulsions different in the grain size or those different in the sensitivity but the same in the grain size can be mixed to form an emulsion layer having substantially one color sensitivity. Otherwise, those emulsions may be individually coated one upon another to form a superposed emulsion layer having substantially one color sensitivity. Furthermore, two or more kinds of polydispersed silver halide emulsions or combinations monodispersed emulsions and polydispersed emulsions may be used in the mixed form or individually superposed form.

The silver halide grains may be of various crystal forms, for example, a regular crystal form such as hexahedron, octahedron, dodecahedron or tetradecahedron, an irregular form such as spherical form, and a mixed form thereof. Tabular grains are also available, and there can be employed an emulsion in which the tabular grains having a ratio of length/thickness of not less than 5, preferably not less than 8, occupy not less than 50% of the all projected areas of the grains. An emulsion composed of a mixture of grains having those various crystal forms is also available.

The silver halide emulsion used in the invention can be prepared in the presence of a silver halide solvent Examples of the silver halide solvents are organic thioethers described in U.S. Patents No. 3,271,157, No. 3,531,289 and No. 3,574,628, and Japanese Patent Provisional Publications No. 54(1979)-1019 and No.54(1979) -158917; and thiourea derivatives described in Japenese Patent Provisional Publications No. 53(1978) -82408, No. 55(1980)-77737 and No. 55(1980) -2982.

In the silver halide emulsion used in the invention, insides of the silver halide grains or surfaces thereof may be subjected to chemical sensitization such as a sulfur sensitization, a selenium sensitization, a reduction sensitization and a precious metal sensitization Those sensitizations can be used singly or in combination.

EXAMPLE 1

An emulsion A was prepared in the following manner.

Emulsion A

To an aqueous solution of gelatin were added an aqueous solution of potassium bromide and an aqueous solution of silver nitrate simultaneously at 75° C. over 5 minutes under vigorous stirring in the presence of a 2-mecapto3,4-methylthiazole solvent in an amount of $2.5\times10^{-3}$ g per 1 mole of Ag, to obtain an emulsion of octahedral silver bromide grains having a mean grain diameter of 0.10 μm. To the emulsion were added sodium thiosulfate and gold(III) trichloride acid (tetrahydric salt) each in an amount of 115 mg per 1 mole of silver, and they were heated at 75° C. for 50 minutes, to perform chemical treatment. To thus obtained cores of silver bromide grains was added potassium hexacyanoferrite(III) in an amount of $6.7\times10^{-5}$ mole per 1 mole of Ag, to grow the grains over 40 minutes in the above-mentioned first precipitation atmosphere while controlling pAg of the solution to 7.50, and finally a monodispersed emulsion of cubic core/shell silver bromide grains having a mean grain diameter of 0.25 μm was obtained. After washing with water for desalting, to the obtained emulsion were added sodium thiosulfate and gold(III) trichloride acid (tetrahydric salt) each in an amount of 3.4 mg per 1 mole of silver, and they were heated at 75° C. for 60 minutes, to chemically sensitize the emulsion. Thus, an internal latent image type silver halide emulsion A was obtained.

Then, to the emulsion A were added the above-exemplified compound (X−2) in an amount of $2.5\times10^{-6}$ mole per 1 mole of Ag as a nucleating agent, the above exemplified compound (II-1) in an amount of $8.7\times10-4$ mole per 1 mole of Ag as a nucleating accelerator, the above-exemplified compound (III-6) in an amount of $1.2\times10^{-3}$ mole per 1 mole of Ag as a sensitizing dye, 4-hydroxy-6-methyl-1,3,3,3a-tetrazaindene and 5-methylbenzotriazole as stabilizers, and 1,3-divinylsulfonyl-2-propanol as a hardening agent.

Independently, to a gelatin solution for forming a surface protective layer were added barium strontium sulfate having a mean particle diameter of 1.0 μm (matting agents), 50 mg/m² of hydroquinone, 20 mg/m² of a compound represented by the following formula, sodium p-dodecylbenzenesulfonate (coating assistant), and a surface active agent represented by the following formula. The resulting mixture and the above-obtained emulsion were simultaneously applied onto a polyethylene terephthalate film in an amount of 1.6 g/m² in terms of silver, to prepare a sample.

(Compound)

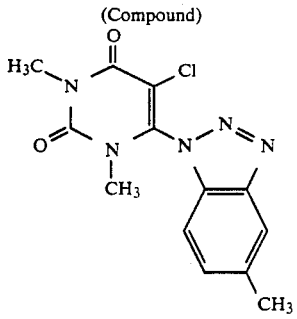

(Surface active agent)

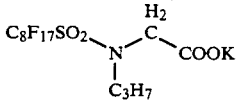

The sample was exposed to a Xenon flash light of $3.75\times10^{-5}$ lux for 10−4 second through a continuous wedge filter.

After the exposure, the sample was developed, at 35° C. for 30 seconds using a developing solution having the following composition (set forth in Table 1) and then subjected to stopping, fixing and washing in a deep tank type automatic developing machine, to obtain a positive image. The obtained results are set forth in Table 2, wherein Dmax and Dmin mean a maximum density of the reversal image and a minimum density thereof, respectively.

TABLE 1

| Developing solution | |
|---|---|
| EDTA.2Na.2H₂O | 5.0 g/liter |
| Na₂SO₃ | 120.0 g/liter |
| Hydroquinone | 30.0 g/liter |
| Metol | 7.0 g/liter |
| Additive A | |
| KBr | 2.0 g/liter |
| Additive B | |
| Water | to make up to 1 liter |
| pH: 11.0 (adjusted with NaOH) | |

TABLE 2

| No. | Additive A (g/liter) | Additive B (g/liter) | Dmax | Dmin | Remark |
|---|---|---|---|---|---|
| 1 | 0 | 0 | 0 | 0 | Comp. |
| 2 | N-methyl-aminoethanol (58.0) | 5-methyl-benzotriazole (0.08) | 3.0 | 0.02 | Comp. |
| 3 | Imidazole (2.0) | 0 | 2.0 | 1.0 | Comp. |
| 4 | N-ethyl-imidazole (4.5) | benzotriazole (0.3) | 2.7 | 0.02 | Comp. |
| 5 | 2-methyl-imidazole (3.6) | 5-methyl-benzotriazole (0.08) | 3.1 | 0.01 | Invention |
| 6 | 2-methyl-imidazole (2.5) | 5-chloro-benzotriazole (0.04) | 3.0 | 0.02 | Invention |

As is evident from Table 2, the imidazole compound is essential to the process of the present invention.

The imidazole compound according to the invention shows an acceleration effect equivalent to that of conventional amines, as is clear from a comparison between No. 2 and No. 5. The imidazole compound further has an advantage of no odor.

Also confirmed is that the imidazole compound is essentially used in combination with the benzotriazole compound to decrease Dmin of the image.

EXAMPLE 2

For preparing a one pack powder type processing agent, the following chemicals were weighed and filled in order in a 20 liter packaging material obtained by laminating polyethylene on an aluminum, and the packaging material was heat-sealed.

| | |
|---|---|
| NaOH | 226 g |
| Na₂SO₃ | 1,000 g |
| KBr* | 24 g |
| 2-methylimidazole | 60 g |
| K₂SO₃ | 1,840 g |
| 4-methyl-4-hydroxymethylpyrazolidone | 100 g |
| Hydroquinone | 840 g |
| EDTA.2Na.2H₂O | 20 g |

*100 g of KBr was mixed with 25 ml of a 1% methanol solution of 5-methylbenzotriazole and then dried.

* 100 g of KBr was mixed with 25 ml of a 1% methanol solution of 5-methylbenzotriazole and then dried.

The above processing agent was compact and had a light weight as compared with a liquid type processing agent (20 liters), and it was excellent in the workability. Further, the powdery processing agent had no risk of such leakage as observed in the liquid type, and hardly had any change with time even when allowed to stand in an atmosphere of high temperature and high humidity. In the liquid type processing agents such as amines, preparation of a one-pack type processing agent is impossible, differently from the example of the invention.

EXAMPLE 3

An emulsion B was prepared in the following manner.

Emulsion B

To an aqueous solution of gelatin were added an aqueous solution of potassium bromide and an aqueous solution of silver nitrate simultaneously at 75° C. over 5 minutes under vigorous stirring in the presence of a 1,8-dihydroxy-3,6-dithiaoctane solvent to obtain an emulsion of octahedral silver bromide grains having a mean grain diameter of 0.15 μm. After the emulsion was adjusted to pAg of 8.20, to the emulsion were added sodium thiosulfate and gold(III) trichloride acid (tetrahydric salt) each in an amount of 115 mg per 1 mole of silver, and they were heated at 75° C. for 50 minutes, to perform chemical treatment. Thus obtained cores of silver bromide grains were treated over 40 minutes in the same manner as in the above-mentioned first precipitation while controlling pAg of the solution to 7.50 to grow the grains, and finally a monodispersed emulsion of cubic core/shell silver bromide grains having a mean grain diameter of 0.25 μm was obtained. After washing with water for desalting, to the obtained emulsion were added sodium thiosulfate and gold(III) trichloride acid (tetrahydric salt) each in an amount of 3.4 mg per 1 mole of silver, and they were heated at 75° C. for 60 minutes, to chemically sensitize the emulsion. Thus, an internal latent image type silver halide emulsion B was obtained.

Then, to the emulsion B were added the compound (X-2) in an amount of $2.5\times10^{-6}$ mole per 1 mole of Ag as a nucleating agent, the compound (II 1) in an amount of $8.8\times10^{-4}$ mole per 1 mole of Ag as a nucleating accelerator, the compound (III-9) in an amount of $1.1\times10^{-5}$ mole per 1 mole of Ag as a sensitizing dye, 4-hydroxy-6-methyl-1,3,3,3a-tetrazaindene as a stabilizer, and 1,3-divinylsulfonyl-2-propanol as a hardening agent.

Independently, to a gelatin solution for forming a surface protective layer were added barium strontium sulfate having a mean particle diameter of 1.0 μm (matting agents), 100 mg/m² of the following dye (1), 100 mg/m² of the following dye (2), sodium p-dodecylbenzenesulfonate (coating assistant), 50 mg/m² of hydroquinone, 20 mg/m² of the compound used on Example 1, and the surface active agent used in Example 1. The resulting mixture and the above-mentioned emulsion were simultaneously applied onto a polyethylene terephthalate film in an amount of 1.6 g/m² in terms of silver, to prepare a sample.

(Dye 1)

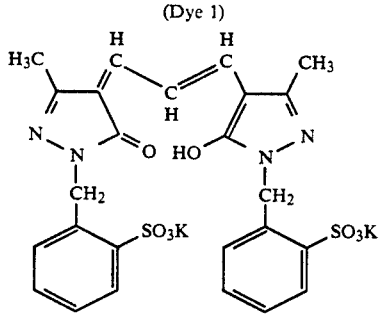

(Dye 2)

-continued

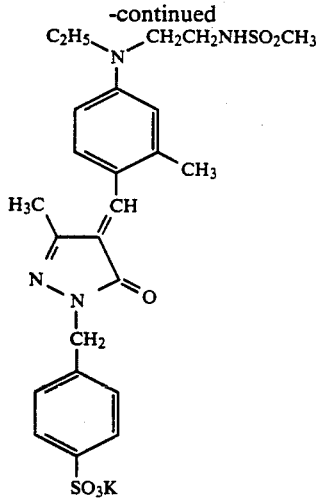

The sample was exposed to a Xenon flash light for $10^{-4}$ second through a continuous wedge filter and an interference filter transmitting a red light of 633 nm.

After the exposure, the sample was developed at 35° C. for 30 seconds using a developing solution having the following composition (set forth in Table 3) using an automatic developing machine (Allen F-10) to obtain a positive image. The obtained results are set forth in Table 4.

TABLE 3

| Remark: C:Comparison I:Invention (No.) | C 1 | I 2 | I 3 | I 4 |
|---|---|---|---|---|
| Components (M/liter) | | | | |
| Pentasodium diethylenetriaminepentaacetate | 1.0 | 1.0 | 1.0 | 1.0 |
| $K_2SO_3$ | 60 | 60 | 60 | 60 |
| $Na_2SO_3$ | 86 | 86 | 86 | 86 |
| Methol | 6 | 6 | 6 | 6 |
| Hydroquinone | 35 | 35 | 35 | 35 |
| 1,2-Dimethylimidazole | — | 0.04 | — | — |
| 1-Ethylimidazole | — | — | 0.04 | — |
| 2-Methylimidazole | — | — | — | 0.04 |
| KBr | 4 | 4 | 4 | 4 |
| 5-Methylbenzotriazole | 0.0006 | 0.0006 | 0.0006 | 0.0006 |
| N-methylaminoethanol | 0.04 | — | — | — |
| pH: 11.0 (by NaOH) | | | | |

TABLE 4

| (No.) | 1 | 2 | 3 | 4 |
|---|---|---|---|---|
| Maximum Density (Dmax) | 1.0 | 2.5 | 2.2 | 2.4 |
| Minimum Density (Dmin) | 0.01 | 0.01 | 0.02 | 0.02 |
| Odor in developing machine | Odor like fish | None | None | None |
| Surface inside machine | Sticky | Not sticky | Not sticky | Not sticky |

As is evident from the results shown in Table 4, the activity of N-methylaminoethanol is very low compared with the imidazole compound of the present invention. Further, the amine has an odor as if fish and makes the inside surface of the machine sticky.

I claim

1. A black and white direct positive image forming process which comprises imagewise exposing to light a silver halide light-sensitive material and developing the material with a black and white developing solution, said light-sensitive material comprising a non-prefogged internal latent image type silver halide emulsion layer provided on a support, and said material further containing a quaternary salt nucleating agent and a nucleating accelerator, wherein the black and white developing solution contains an imidazole compound represented by the formula [A] and a benzotriazole compound represented by the formula [b]:

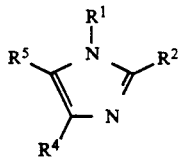

[A]

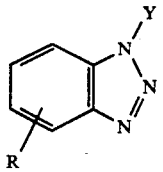

[B]

wherein each of $R^1$, $R^2$, $R^4$ and $R^5$ independently is hydrogen, an alkyl group, a hydroxyalkyl group or an alkenyl group; Y is hydrogen or mercapto; R is hydrogen, a halogen atom, nitro, amino cyano, hydroxyl, mercapto, sulfo, carboxyl, an alkyl group, an alkenyl group, an alkynyl group, an aryl group, an alkoxy group, an acyl group or an alkoxycarbonyl group, and wherein the amount of the benzotriazole compound is in the range of 0.1 to 10 wt.% of the amount of the imidazole compound, and the amount of the benzotriazole compound is also in the range of 0.02 to 0.1 g based on 1 liter of the developing solution.

2. The process as claimed in claim 1, wherein at least one of $R^1$, $R^2$, $R^4$ and $R^5$ in the formula is an alkyl group or a hydroxyalkyl group.

3. The process as claimed in claim 1, wherein the number of the carbon atom contained in each of $R^1$, $R^2$, $R^4$ and $R^5$ in the formula is 10 or less.

4. The process as claimed in claim 1, wherein Y in the formula is hydrogen.

5. The process as claimed in claim 1, wherein R in the formula is attached to 5-position of the benzotriazole ring.

6. The process as claimed in claim 1, wherein the amount of the imidazole compound is in the range of 0.1 to 20 g based on 1 liter of the developing solution.

7. The process as claimed in claim 1, wherein the developing solution is fed from a one-pack type powdery developing agent.

8. The process as claimed in claim 1, wherein the developing solution further contains a dihydroxybenzene developing agent.

9. The process as claimed in claim 1, wherein the image is formed from computer output.

10. The process as claimed in claim 1, wherein the light-sensitive material is a microfilm.

11. The process as claimed in claim 1, wherein the image is a black and white binary image.

12. The process as claimed in claim 1, wherein the quaternary salt nucleating agent is represented by the formula [X]:

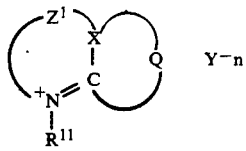

[X]

wherein X is

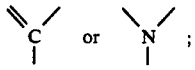

$Z^1$ is a nonmetallic atom group forming a 5- or 6-membered heterocyclic ring; the heterocyclic ring may be condensed with an aromatic ring or a heterocyclic ring; $R^{11}$ is an aliphatic group; Q is a non-metallic atom group forming a 4- to 12-membered nonaromatic hydrocarbon or heterocyclic ring; at least one of $R^{11}$, the substituent groups of $Z^1$ and the substituent groups of Q contains an alkynyl group; Y is a counter ion for charge balance; and n is a number necessary for keeping the charge balance.

13. The process as claimed in claim 1, wherein the nucleating accelerator is a thiadiazole, diazole, triazole or tetrazole compound having a mercapto group.

14. The process as claimed in claim 1, wherein the silver halide emulsion is spectrally sensitized with a sensitizing dye represented by the formula:

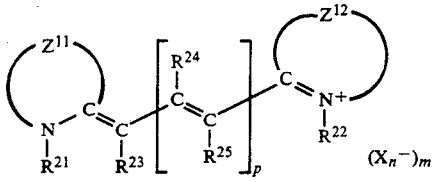

[III]

wherein each of $Z^{11}$ and $Z^{12}$ independently is an atom group forming a 5- or 6-membered nitrogen-containing heterocyclic ring; p is 0 or 1; each of $R^{21}$ and $R^{22}$ independently is an alkyl group or an alkenyl group having 10 or less carbon atoms; each of $R^{23}$ and $R^{25}$ is hydrogen, or in the alternative, $R^{23}$ and $R^{21}$ or $R^{25}$ and $R^{22}$ may be linked to each other to form a 5- or 6-membered ring; $R^{24}$ is a hydrogen atom or an alkyl group having 10 or less carbon atoms; $X_n$ is an anionic residue of an acid; and m is 0 or 1.

* * * * *